US006247511B1

(12) United States Patent
Maeda et al.

(10) Patent No.: US 6,247,511 B1
(45) Date of Patent: Jun. 19, 2001

(54) METHOD AND APPARATUS FOR CUTTING WOODEN PLATES

(75) Inventors: Koji Maeda; Kazuhiro Otani; Tomio Izumi; Junji Tsuji, all of Osaka; Katsuji Hasegawa, Aichi; Tsuyoshi Fukui, Aichi; Kenichi Hiraiwa, Aichi, all of (JP)

(73) Assignees: Taihei Machinery Works, Ltd., Komaki; Meinan Machinery Works, Inc., Obu, both of (JP)

( * ) Notice: Subject to any disclaimer, the term of this patent is extended or adjusted under 35 U.S.C. 154(b) by 0 days.

(21) Appl. No.: 09/387,551

(22) Filed: Sep. 1, 1999

(30) Foreign Application Priority Data

Sep. 3, 1998 (JP) ..... 10-249849

(51) Int. Cl.[7] ..... B27L 11/00; B27C 1/00

(52) U.S. Cl. ..... 144/375; 144/117.1; 144/242.1; 144/246.2; 144/250.13; 144/356; 144/357; 144/382; 144/248.4; 198/624

(58) Field of Search ..... 144/114.1, 116, 144/117.1, 242.1, 246.2, 248.4, 250.16, 356, 357, 373, 375; 198/624, 722, 836.2

(56) References Cited

U.S. PATENT DOCUMENTS 2,102,186 * 12/1937 Nicholson et al. ..... 144/116
2,642,902 * 6/1953 Carey ..... 144/117.1
2,679,871 * 6/1954 Ford ..... 144/250.13
3,082,802 * 3/1963 Dickson et al. ..... 144/117.1
3,990,568 * 11/1976 Wilson, Sr. ..... 144/246.2
4,031,932 * 6/1977 Leasure ..... 144/117.1
4,438,795 3/1984 Plough .
4,457,350 * 7/1984 Finnila ..... 144/117.1
4,724,877 * 2/1988 Culley, Jr. ..... 144/116
5,368,077 * 11/1994 Croghan et al. ..... 144/246.1
5,373,879 * 12/1994 Kuhnhenrich ..... 144/356
5,396,938 * 3/1995 Cannady ..... 144/357

FOREIGN PATENT DOCUMENTS 368026 2/1974 (SU) .

* cited by examiner

*Primary Examiner*—W. Donald Bray
(74) *Attorney, Agent, or Firm*—Wenderoth, Lind & Ponack, L.L.P.

(57) ABSTRACT

A rotatable roll is provided under a planing cylinder rotating at a fixed position. A front feed unit and a rear feed unit having an upper and a lower roll for gripping the plate are provided upstream and downstream of the planing cylinder with respect to the feed direction of the plate. A front movable body and a rear movable body having an upper and a lower roll for gripping the plate member are provided between the planing cylinder and the front feed unit and between the planing cylinder and the rear feed unit. The upper and lower rolls of the front and rear movable bodies are forcibly moved up and down. The plate member is supported at three points and deflected downward to prevent floating of the plate during cutting and to prevent the formation of depressions in the plate near its front and rear ends during cutting.

16 Claims, 20 Drawing Sheets

METHOD AND APPARATUS FOR CUTTING WOODEN PLATES

BACKGROUND OF THE INVENTION

This invention relates to a method and apparatus for automatically cutting or smoothening the surface of a wooden plate while feeding it.

FIG. 18 shows a conventional wood planing machine for automatically cutting the surface of a wooden plate while feeding it. This planing machine comprises a horizontal table 2 fixed to a base 1, a rotary planing cylinder 3 provided over the table 2, and a front (with respect to the feed direction of the plate) feed unit 4 and a rear feed unit 5 having vertically arranged rollers into which the plate is inserted. The planing machine further includes a chip breaker 6 provided between the planing cylinder 3 and the front feed unit 4, and a pressure bar 7 disposed between the planing cylinder 3 and the rear feed unit 5.

The planing cylinder 3 carries a plurality of planing blades 8 on its outer circumference. The upper and lower rollers 10, 9 of the front and rear feed units 4, 5 are both motor-driven, and the upper rollers 10 are vertically movable and normally urged toward the stationary lower rollers 9 by air cylinders 11 or springs. Thus, by driving the rollers 9, 10, a wooden plate A can be fed at a constant speed.

The pressure bar 7 and the chip breaker 6 are independently movable vertically, and are biassed downwardly by air cylinders 12 or springs to press the plate A against the table 2.

When a plate A is fed on the table from the front feed unit 4 with the cylinder 3 rotating, the plate passes under the planing cylinder 3 while being pressed against the table 2 by the chip breaker 6. After its surface has been cut by the planing cylinder 3, it is pressed against the table 2 by the pressure bar 7, and fed out by the rear feed unit 5. The surface of the plate is thus cut over the entire length while being fed at a constant speed.

The chip breaker 6 and the pressure bar 7 press the plate A against the table 2 to prevent shaky motion of the plate during planing and insure stable working. In order to prevent interference with the planing cylinder 3 when they are moved vertically, the chip breaker 6 and the pressure bar 7 are spaced by distances C and B, respectively, from the center of the cylinder, as shown in FIG. 18.

Thus, the leading and trailing ends of the plate are not gripped but get free while the tip of the plate is moving through the interval C and while the rear end of the plate is moving through the interval B, respectively. Thus, over-cut portions or depressions a tend to be formed in the plate near its front and rear ends as shown in FIG. 19, especially if the plate has a tendency to cock.

If, in order to prevent the formation of such depressions, the chip breaker 6 and the pressure bar 7 are pressed harder against the plate, a braking force is applied so that greater power will be needed to feed the plate.

An object of this invention is to provide a method and apparatus for planing a wooden plate which can prevent the formation of depressions without increasing the feed resistance and the plate feed power.

SUMMARY OF THE INVENTION

According to this invention, there is provided a method of cutting a plate wherein a front feed unit and a rear feed unit are provided in front of and behind of a cutter and a reaction force bearing with respect to the feed direction of the plate.

Also, a front movable body is provided between the cutter and the front feed unit and a rear movable body is provided between the cutter and the rear feed unit. The plate is deflected by at least one of the front movable body and the rear movable body when the plate is fed into between the cutter and the reaction force bearing, thereby bringing the plate into contact with the front feed unit, the front movable body and the reaction force bearing, and/or the reaction force bearing, the rear movable body and the front movable body.

Other features and objects of the present invention will become apparent from the following description made with reference to the accompanying drawings, in which:

DETAILED DESCRIPTION OF THE PREFERRED EMBODIMENT

Embodiments of this invention are described with reference to FIGS. 1 through 17.

(First Embodiment)

Figure 1:
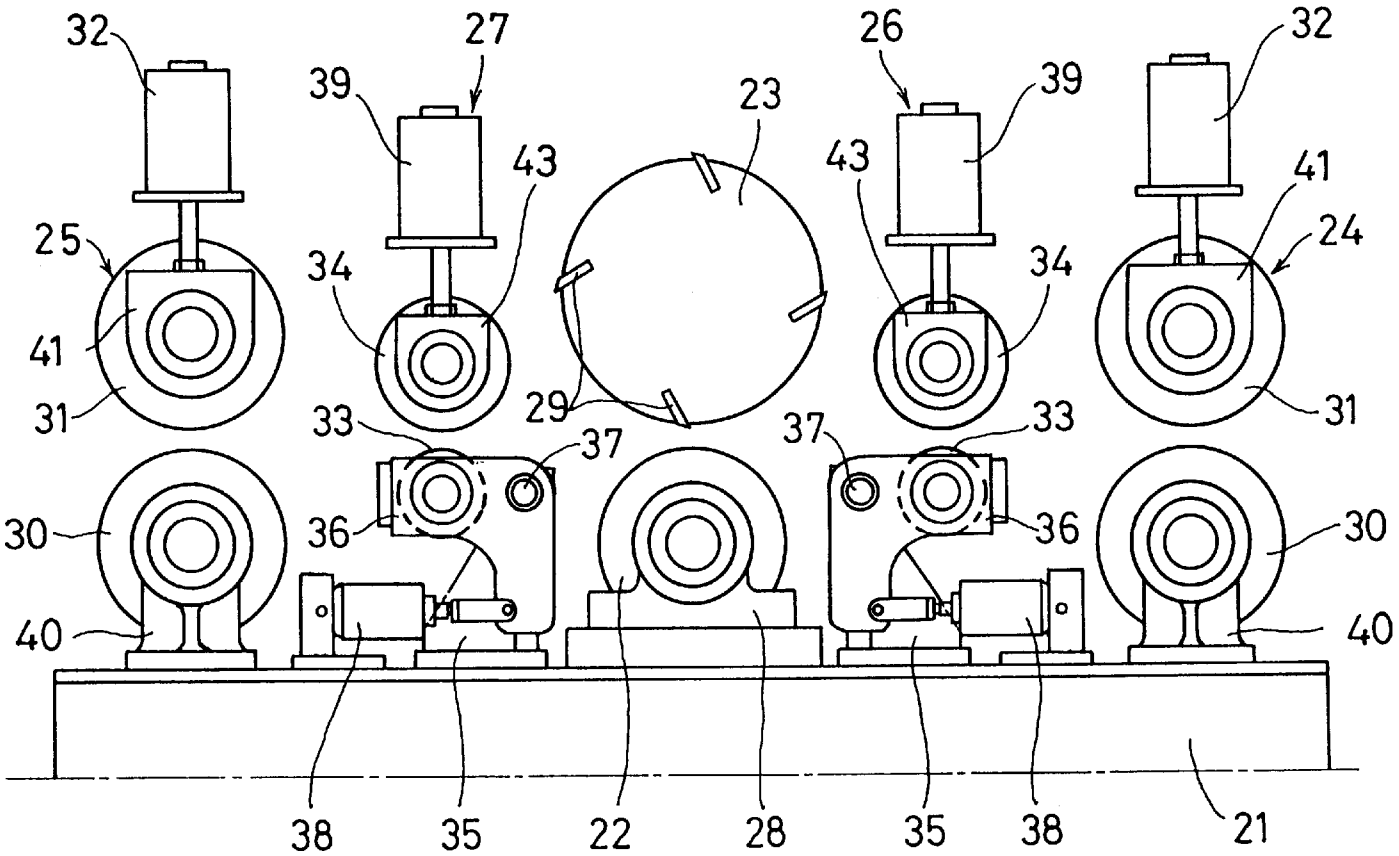
FIG. 1 is a front view of a cutting device of a first embodiment.
Figure 2:
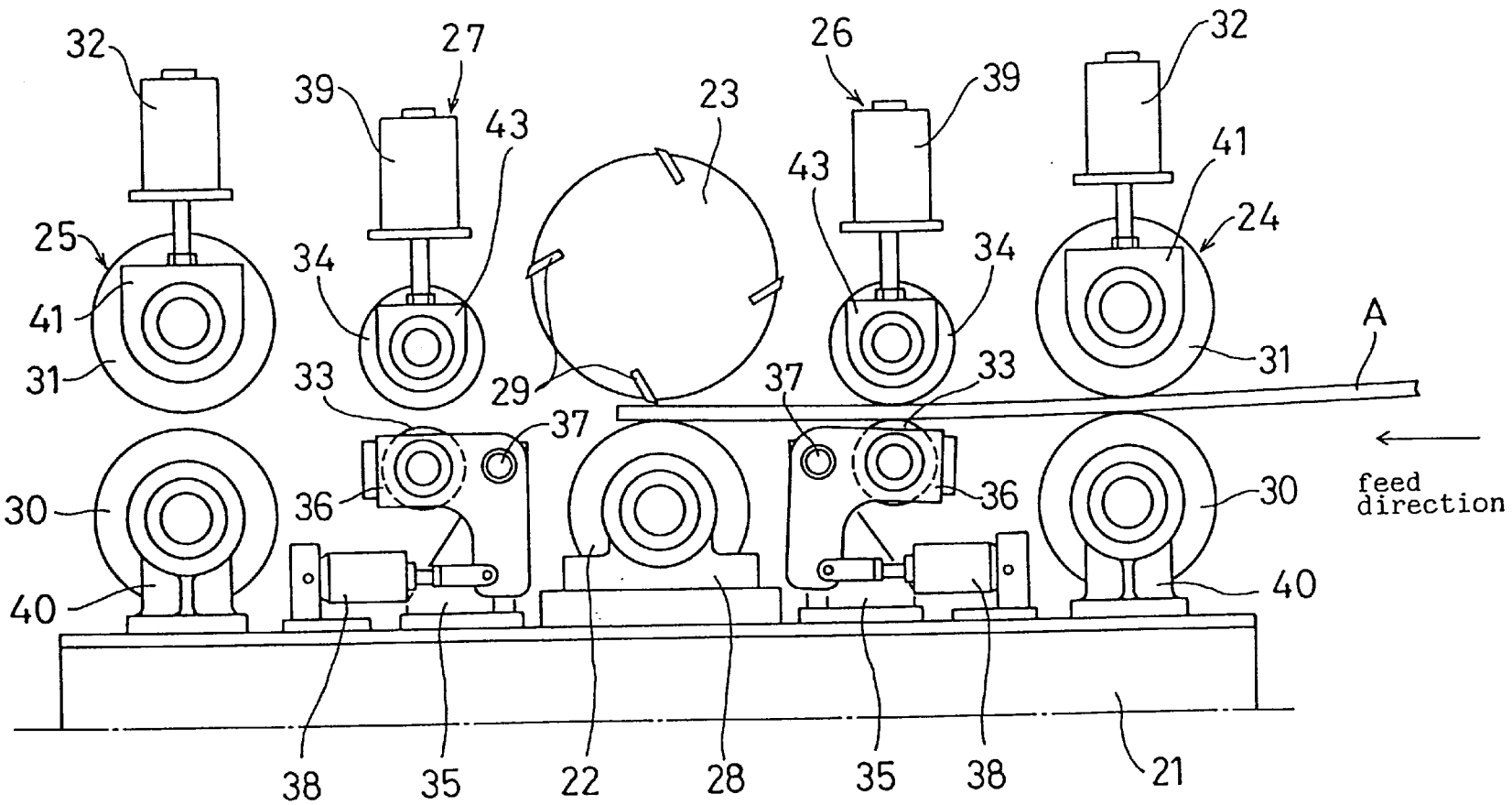
FIG. 2 is a front view of the cutting device showing the initial stage of feed of a plate.
Figure 3:
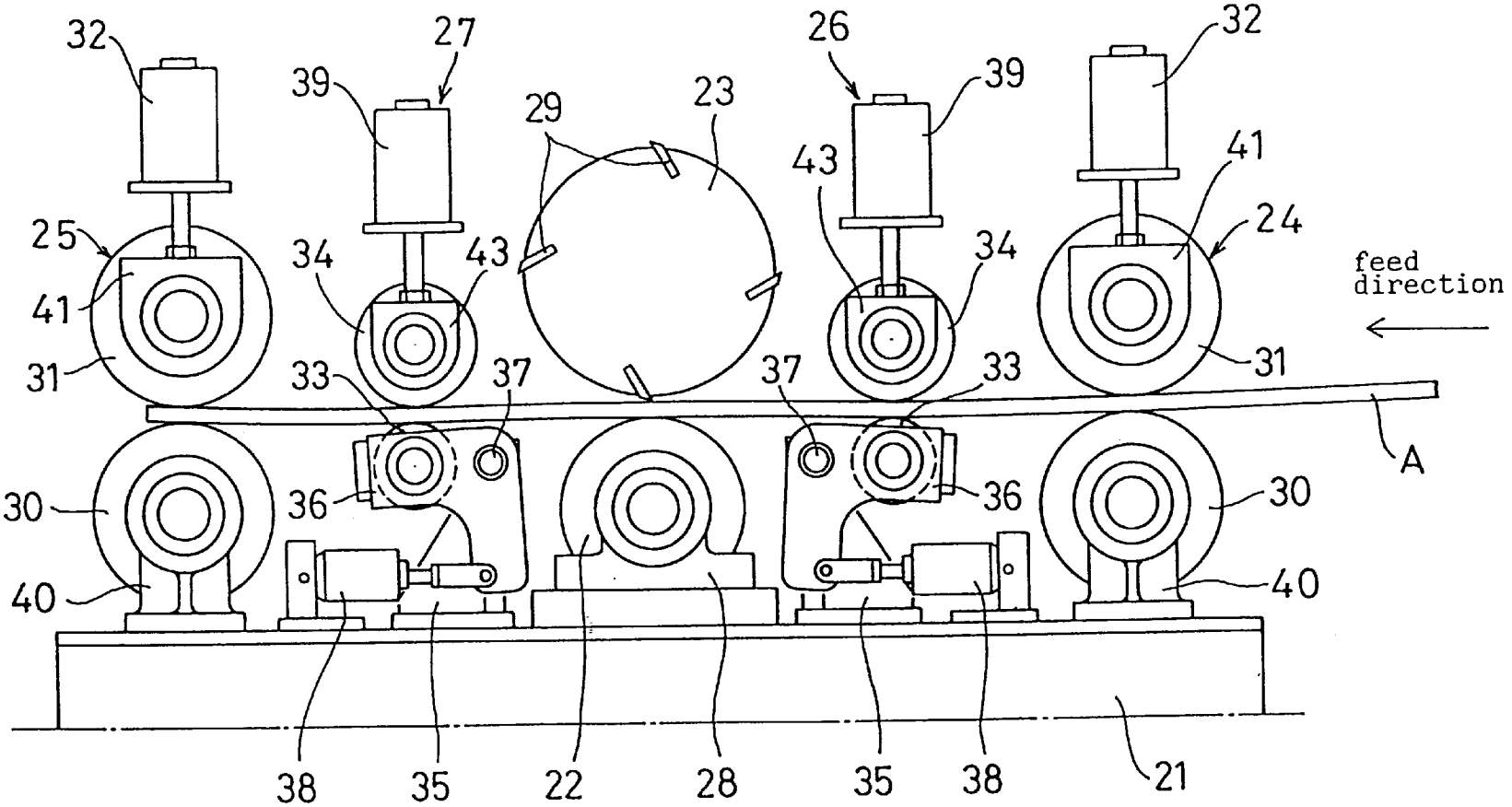
FIG. 3 is a front view of the cutting device showing the next stage.

FIGS. 1 through 3 show a device for planing wooden plates embodying the invention. This device comprises a plate support roll 22 (that is, a reaction force bearing or reaction force bearing member) provided on a base 21 at its center, a planing cylinder 23 (or cutter) provided right over and opposite the plate support roll 22, front and rear feed units 24, 25 provided in front (with respect to the feed direction of a plate A) and rear of the planing cylinder 23 and having vertically arranged rolls into which the plate A is inserted, and front and rear movable bodies 26, 27 comprising vertically arranged rolls between which the plate A is caught. The plate gripping portions between the plate support roll 22 and the planing cylinder 23, those of the front and rear feed units 24, 25, and those of the front and rear movable bodies 26, 27 are aligned with each other along the feed line of the plate A.

The plate support roll 22 has both ends thereof supported by bearings 28 fixed to the base 21 so as to be rotatable, and serves as a reaction force bearing. The planing cylinder 23, disposed directly right over the plate support roll 22 carries a plurality of planing blades 29 on its circumferential surface, and rotates while keeping a predetermined distance from the plate support roll 22.

The front and rear feed units 24 and 25 are identical in structure. So the same elements are denoted by the same numerals. They comprise a motor-driven lower roll 30 rotatably supported at both ends by bearings 40 fixed to the base 21, and a motor-driven upper roll 31 vertically movably provided directly over the lower roll 30 and rotatably supported at both ends by bearings 41. The upper roll 31 is urged downward by urging means such as a hydraulic cylinder 32 or pulse motors, or by springs. A plate A is caught between the upper and lower rolls 30, 31 and fed at a constant speed.

The front and rear movable bodies 26, 27 are identical in structure, so the same elements are denoted by the same numerals. They comprise a vertically pivotable lower roll 33 and a vertically movable upper roll 34 provided right over the lower roll 33. Tumbled L-shaped swing arms 36 have their bases pivotally supported on a pivot 37. The lower roll 33 is rotatably supported on the upper leg of the arm 36 at one end. The arms 36 have the other ends coupled to the rods of hydraulic cylinders 38 fixed to the base 21. By extending and retracting the cylinders 38, the lower rolls 33 are vertically pivoted about the pivot 37.

Figure 1A:
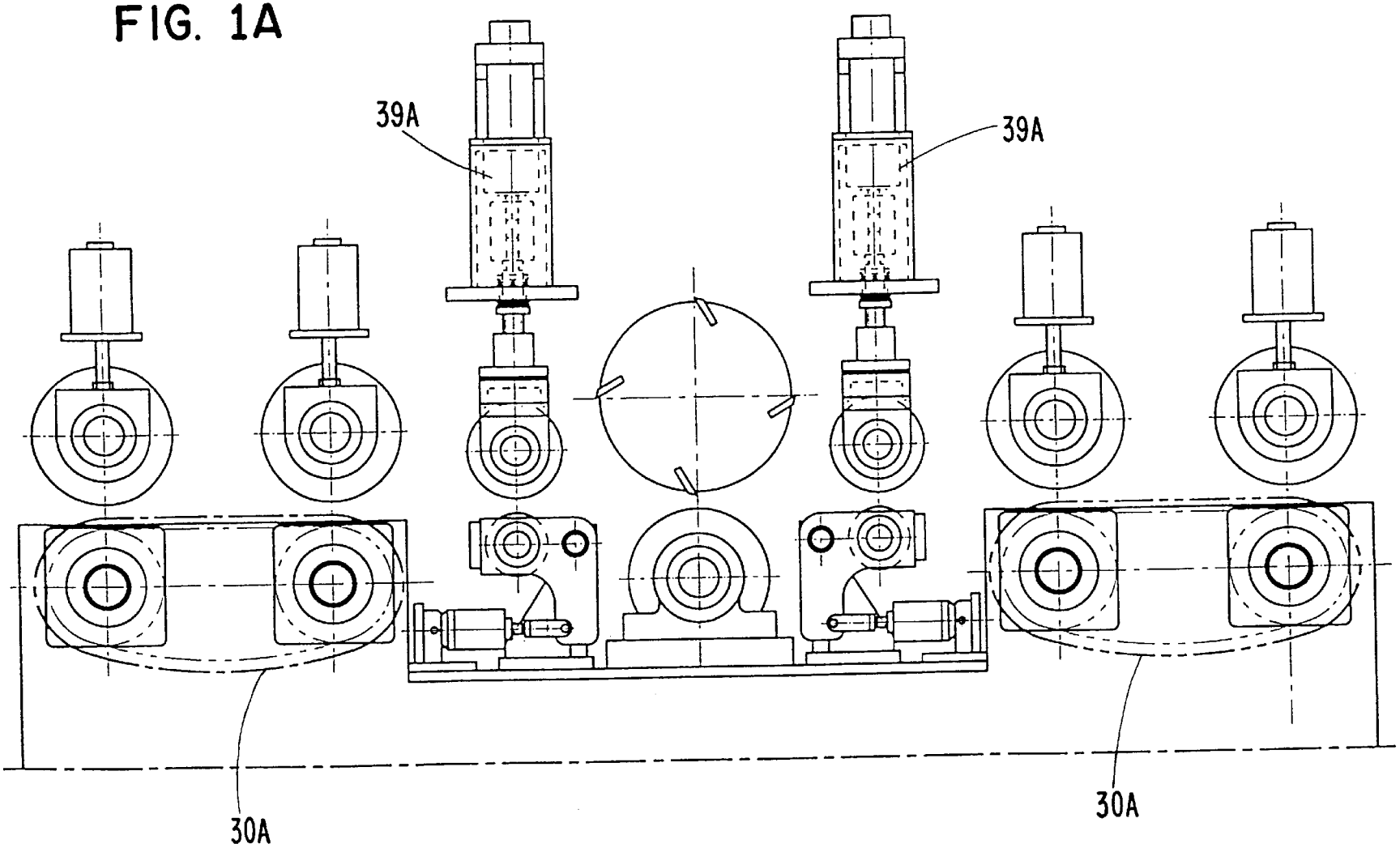
FIG. 1A is a front view of a cutting device that is a modified version of the cutting device shown in FIG. 1.

The upper rolls 34 have both ends thereof rotatably supported by bearings 43, and are urged downward by hydraulic cylinders 39 or pulse motors 39A (see FIG. 1A) or springs. A plate A is gripped between the upper and lower rolls.

Figure 16A:
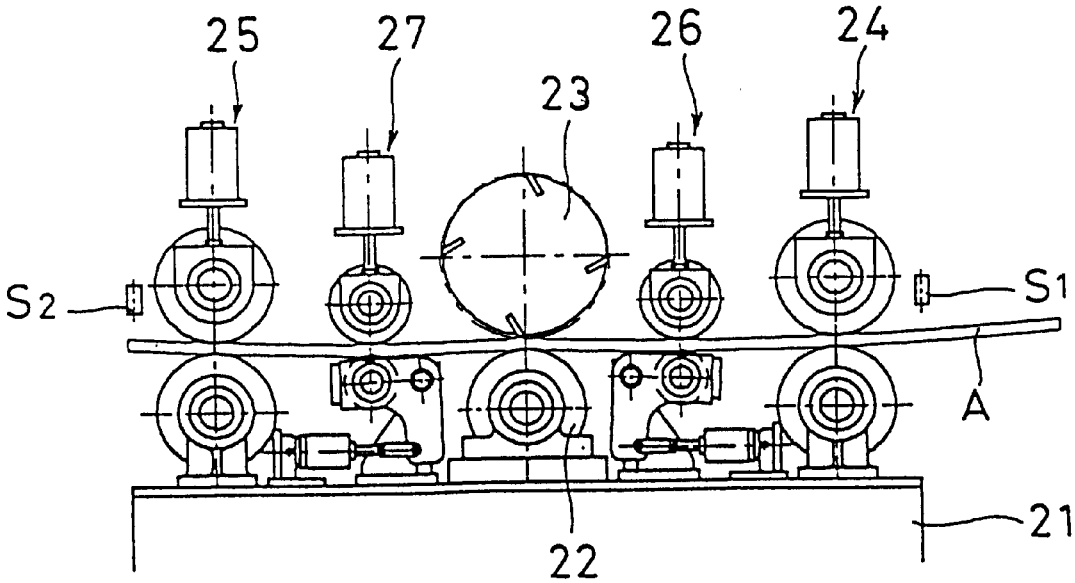
FIGS. 16A, 16B are further views showing the operation of the first embodiment.
Figure 16B:
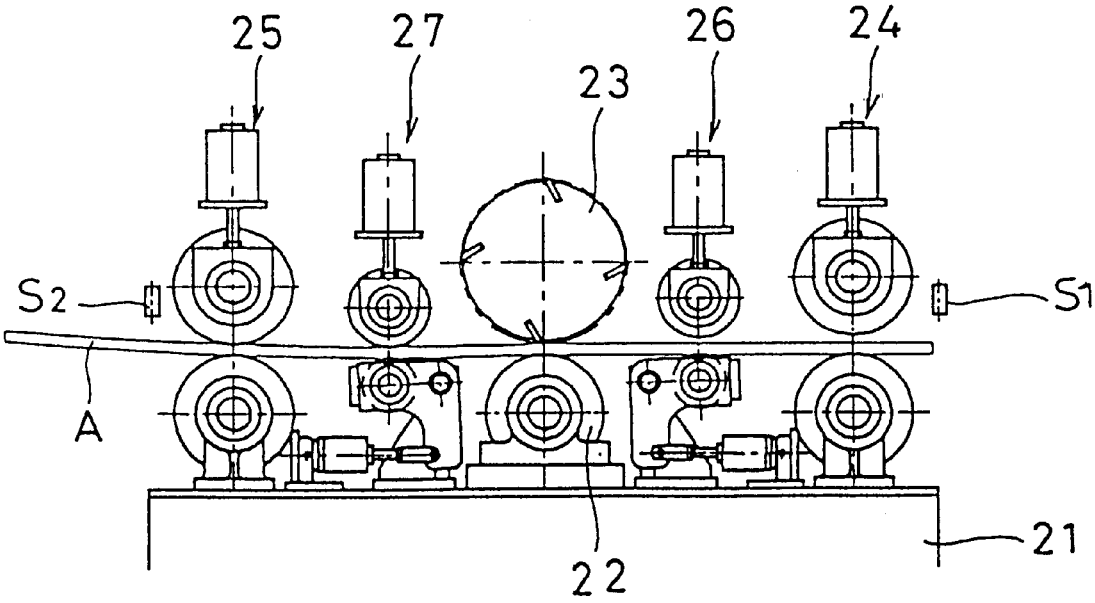
Figure 17:
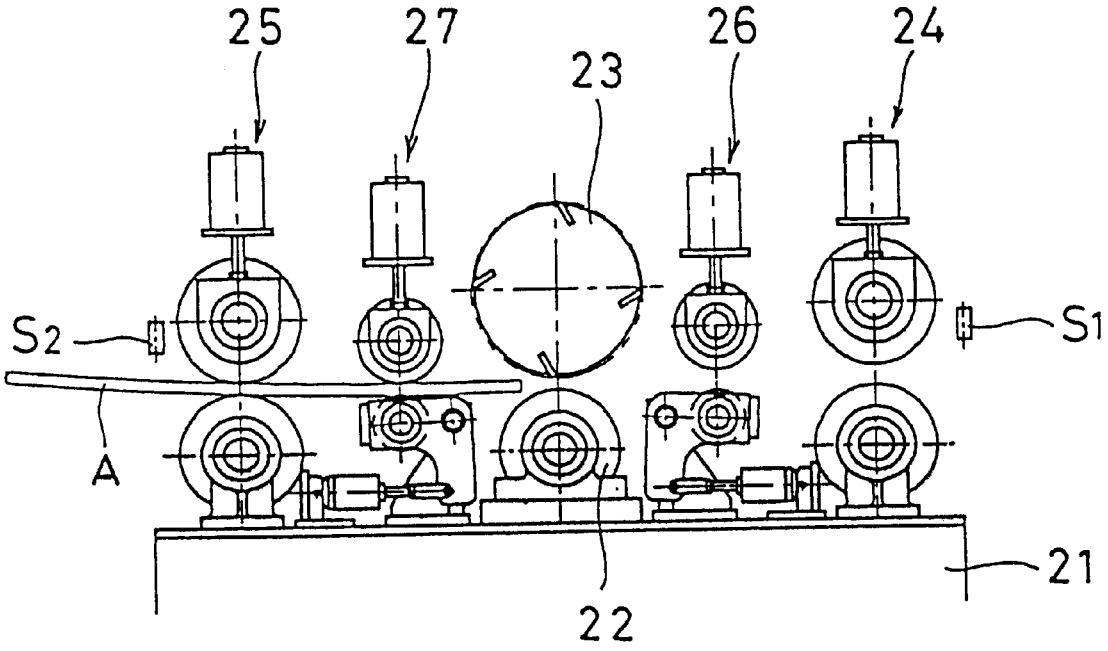
FIGS. 17 is another view showing the operation of the first embodiment.
Figure 18:
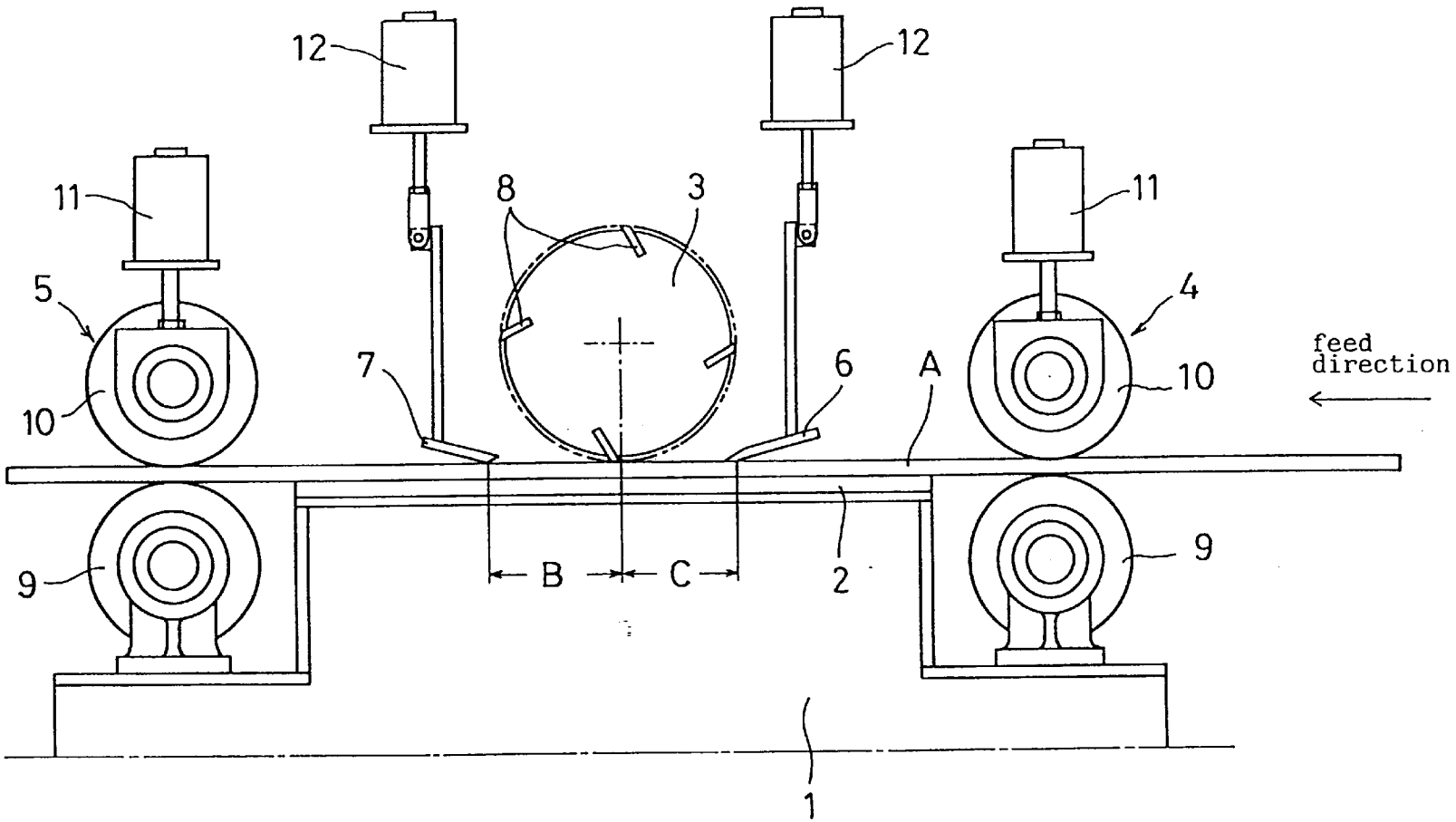
FIG. 18 PRIOR ART
FIG. 18 is a front view of a conventional cutting device, i.e. a planing machine.
Figure 19:
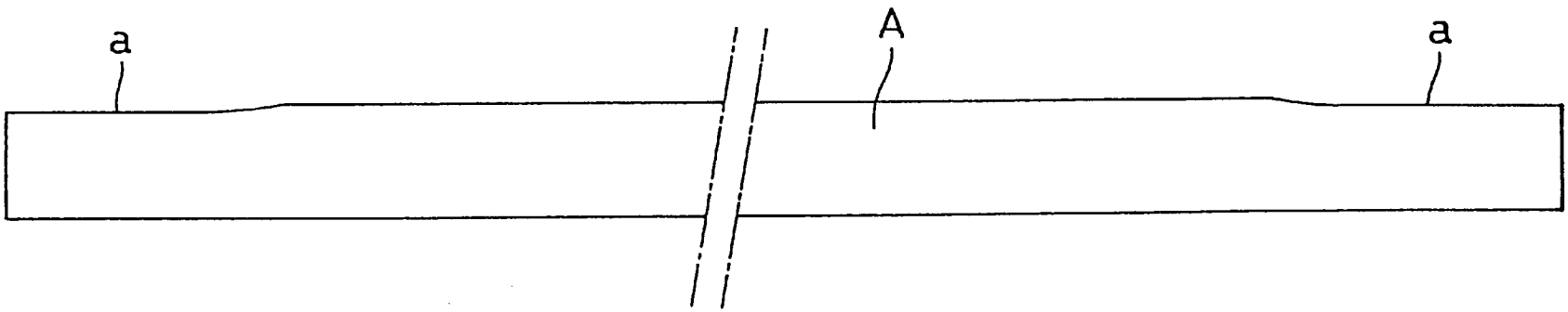
FIG. 19 PRIOR ART
FIG. 19 is a front view of the conventional planing machine showing its operation.

FIGS. 15 through 17 show in sequence the method of controlling the rolls of the planing device of the first embodiment.

Figure 14:
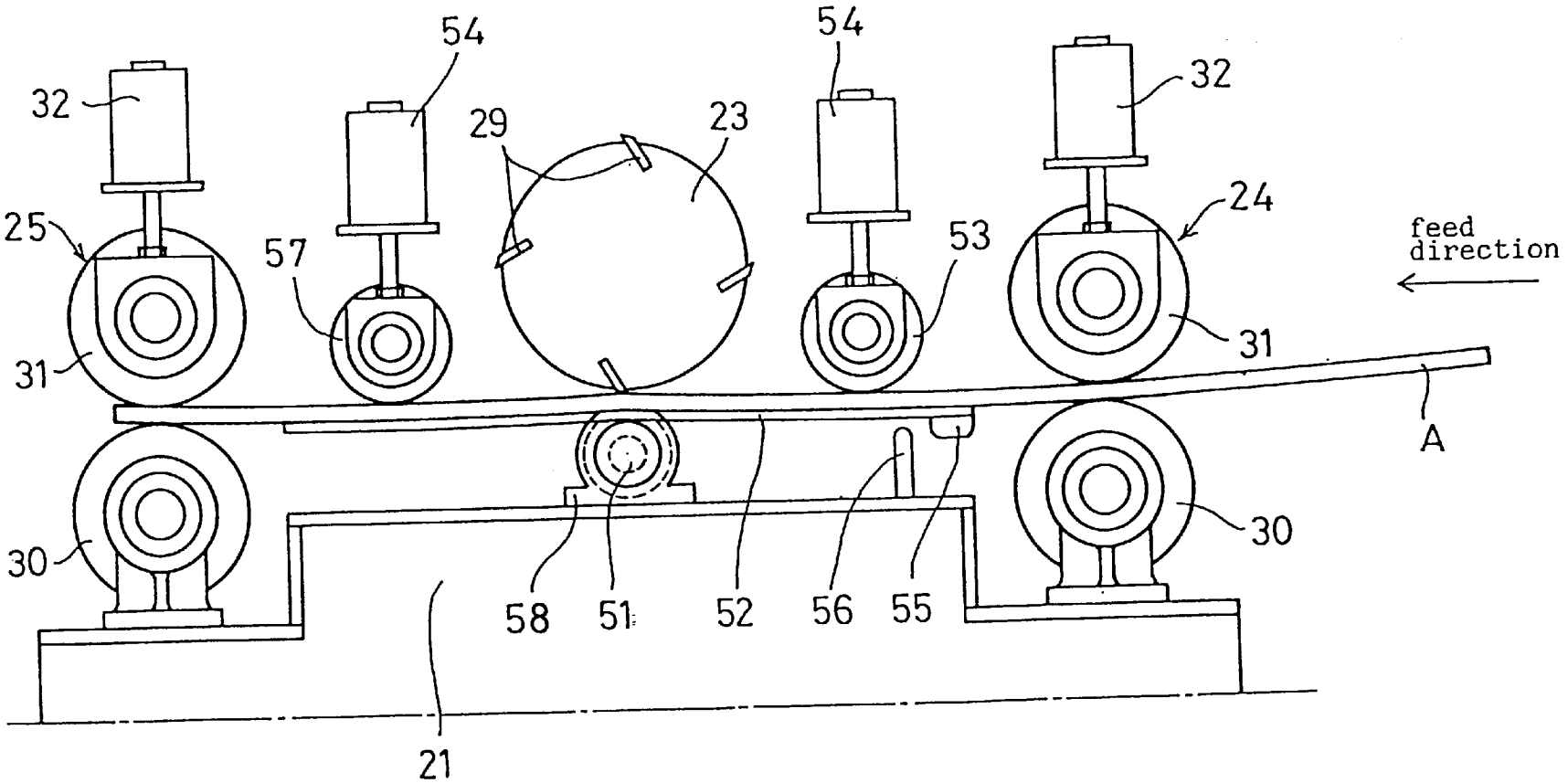
FIG. 14 is a front view of the cutting device of FIG. 12 showing the next stage.
Figure 15A:
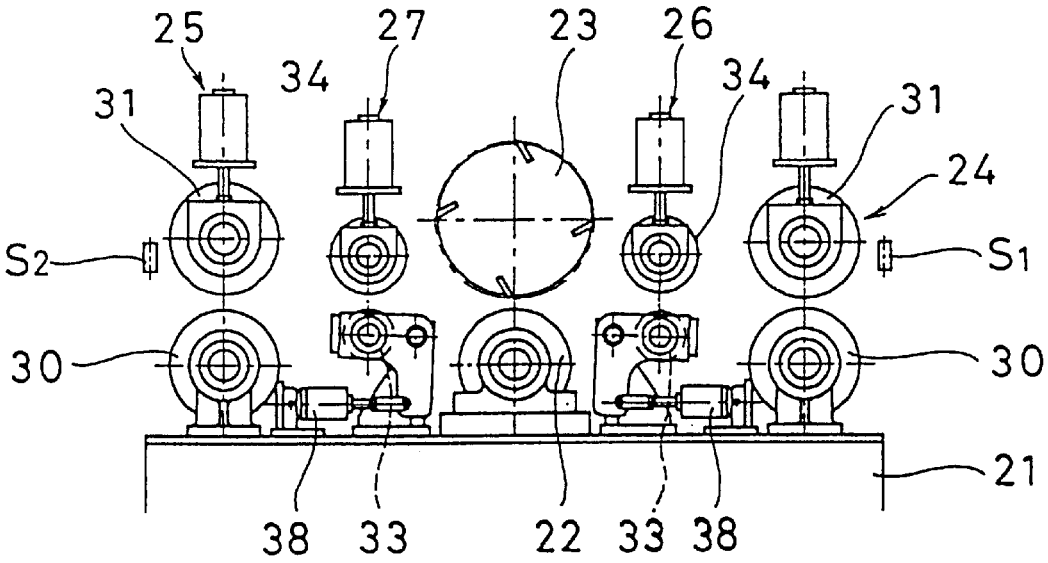
FIGS. 15A, 15B are views showing the operation of the first embodiment.

FIG. 15A shows the state before the plate A is fed. The plate detector switches S1 and S2 at the inlet and outlet are both off. The upper roll 31 of the front feed unit 24 is in its lowered position. The upper rolls of the front and rear movable bodies 26, 27 and the rear feed unit 25 are in their raised position. Although plate detector switches S1 and S2 at inlet and outlet are used in the first embodiment shown in FIGS. 1 through 3, as well as in the following second to fifth embodiments shown in FIGS. 4 through 14, these switches are omitted in these figures.

Figure 15B:
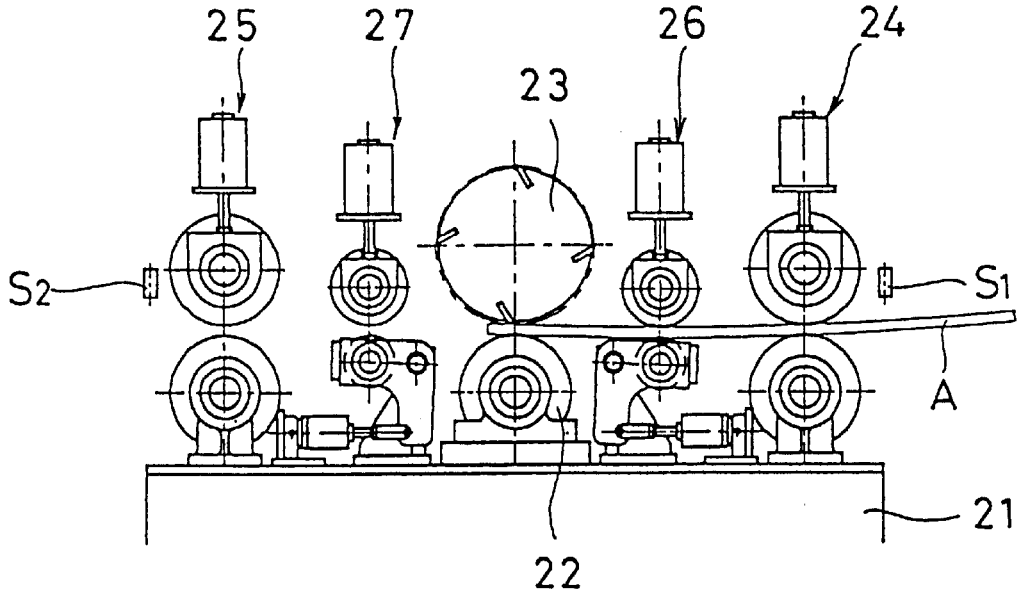

When a plate A is fed into between the upper and lower rolls 30 and 31 of the front feed unit 24 with the cylinder 23 and the upper and lower rolls 30, 31 of the front and rear feed units 24, 25 rotating as shown in FIG. 15B, the inlet plate detector switch S1 is turned on, and the upper roll 34 of the front movable body 26 lowers to a lowered position while the upper roll 31 of the front feed unit 24 remains at its lowered position, with the upper roll 34 of the rear movable body 27 and the upper roll 31 of the rear feed unit 25 remaining at the raised position, and the outlet plate detector switch S2 off. The plate A is thus fed and caught between the upper and lower rolls 33, 34 of the front movable body 26, so that it is pressed down a predetermined distance or interference, and is fed into between the support roll 22 and the planing cylinder 23.

As shown in FIGS. 2 and 15B, the plate A is fed while being caught between the upper and lower rolls 33, 34 of the front movable body 26 and urged by a predetermined interference downwardly from the feed surface connecting the lower roll 30 of the front feed unit 24 and the support roll 22. When the leading end of the plate A reaches the support roll 22, it thus rides onto the support roll 22, so that the plate A is bent or deflected downward between the support roll 22 and the lower roll 30 of the front feed unit 24.

Thus, the plate A is reliably kept pressed against the support roll 22 into line contact therewith. This prevents floating of the plate A when its leading end enters into between the support roll 22 and the planing cylinder 23. When the plate A passes between the support roll 22 and the planing cylinder 23, its surface is cut or smoothened by the rotating planing cylinder 23. The leading end of the plate A is then fed to the rear movable body 27 and the rear feed unit 25.

As shown in FIGS. 3 and 16A, when the leading end of the plate A passes the rear feed unit 25 and the outlet plate detector switch S2 is turned on, the upper rolls 31, 34 of the rear movable body 27 and the rear feed unit 25 lower to their lowered positions, so that plate A is gripped between the upper and lower rolls 33, 34 of the rear movable body 27 and pressed down by a predetermined interference from the feed line connecting the support roll 22 and the lower roll 30 of the rear feed unit 25. Thus, the plate A is fed while being kept pressed reliably against and in line contact with the support roll 22.

As shown in FIG. 16B, when the rear end of the plate A passes the inlet plate detector switch S1, the switch S1 is turned off, so that the upper rolls 31, 34 of the front feed unit 24 and the front movable body 26 move upward from their lowered positions. But since the upper rolls 31, 34 of the rear movable body 27 and the rear feed unit 25 remain at their lowered positions, the plate is fed while being deflected downwardly between the support roll 22 and the lower roll 30 of the rear feed unit 25. Thus the plate A is fed while being pressed reliably against and keeping line contact with the support roll 22. Thus, it is possible to prevent the plate from floating when its rear end passes between the support roll 22 and the planing cylinder 23.

As described above, for the support roll 22 and the planing cylinder 23, by deflecting the plate A by means of the front and rear movable bodies 26, 27 by a predetermined distance downwardly from the feed line connecting the lower rolls 30 of the front and rear feed units 24, 25 and the support roll 22 and supporting it at three points, the plate A is reliably brought into line contact with the support roll 22 at its front and rear ends without floating. It is thus possible to prevent the formation of depressions in the plate near its front and rear ends.

FIG. 17 shows a state when the rear end of the plate A has passed the planing cylinder 23. All parts maintain the same position as in FIG. 16B. When the rear end of the plate A passes the outlet plate detector switch S2 and the switch is turned off, each part returns to the position shown in FIG. 15A.

(Second Embodiment)

Figure 4:
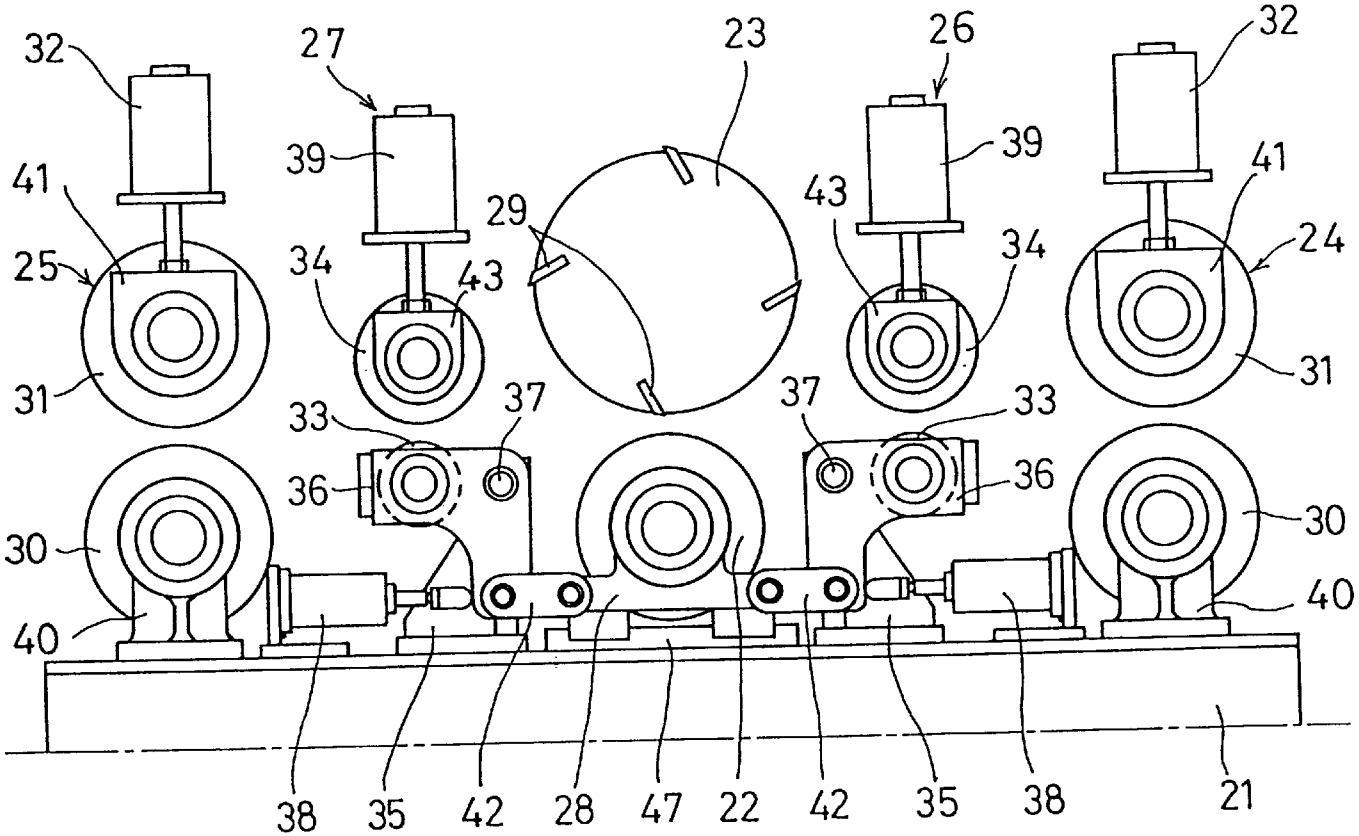
FIG. 4 is a front view of a cutting device of a second embodiment.
Figure 5:
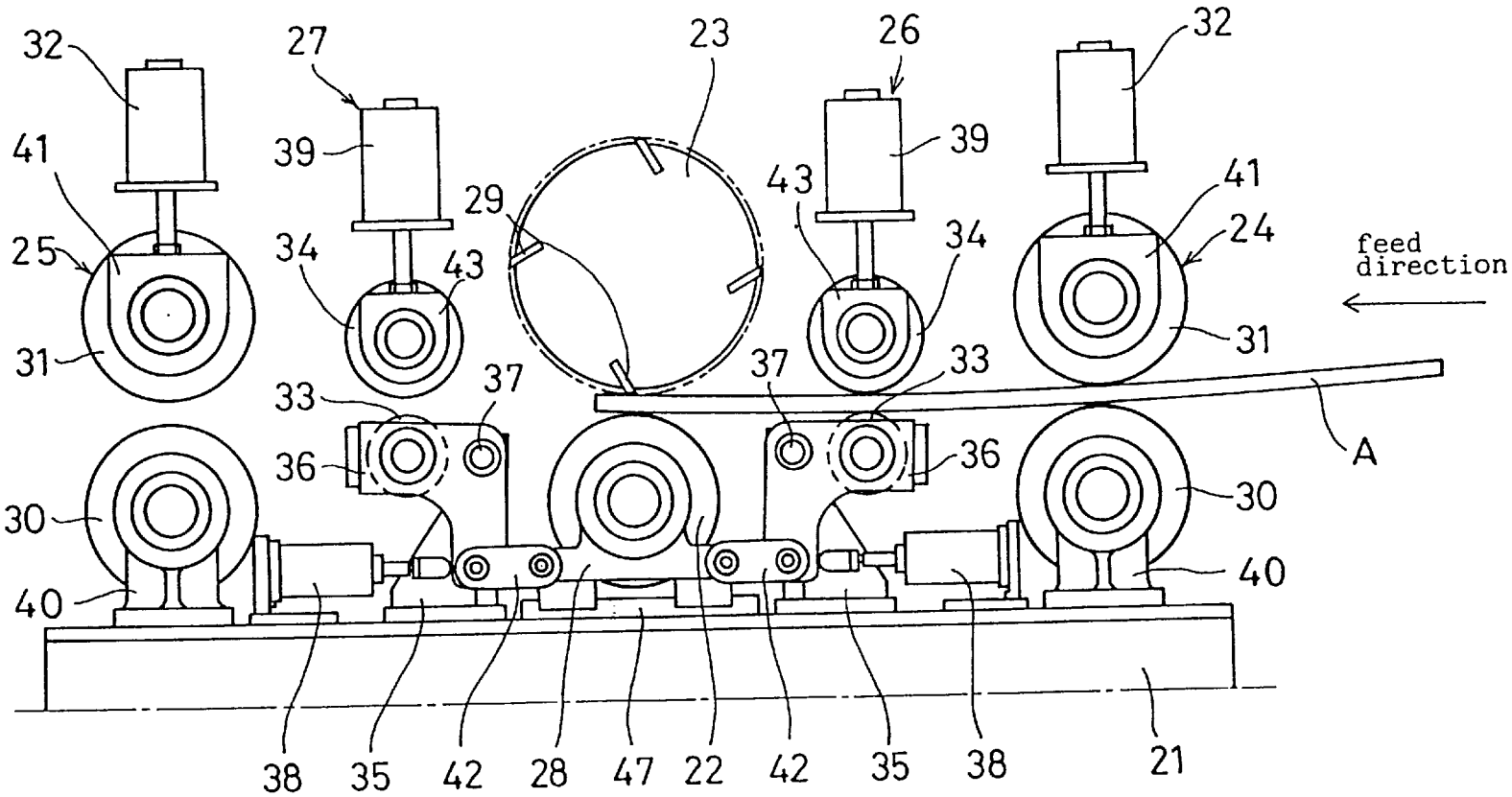
FIG. 5 is a front view of the cutting device of FIG. 4 showing the initial state of feed of a plate.
Figure 6:
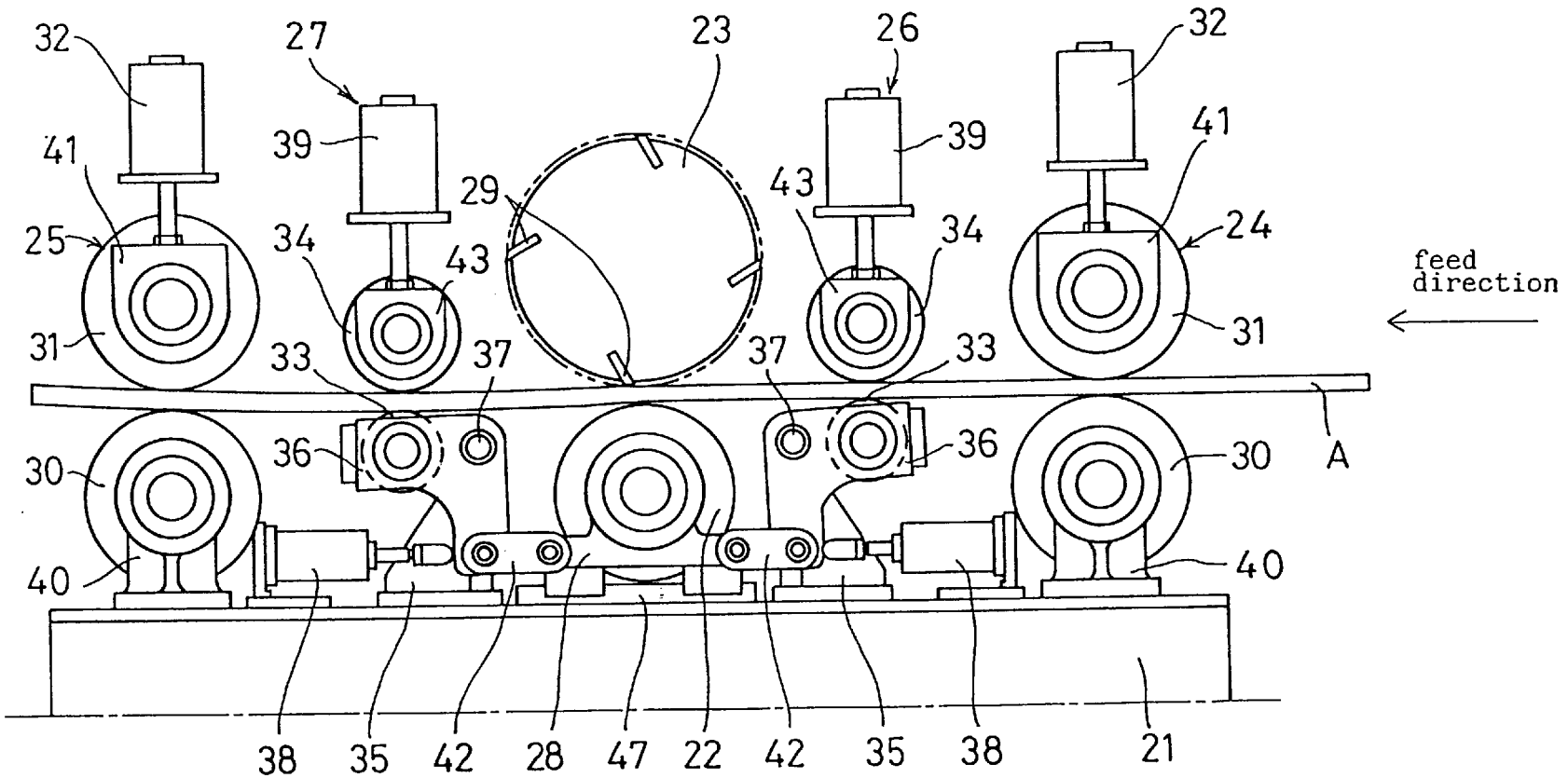
FIG. 6 is a front view of the cutting device of FIG. 4 showing the next stage.

FIGS. 4 through 6 show a cutting device of a second embodiment. Basically, the mechanism of the first embodiment is used to finish the plate A so that its thickness will be uniform over the entire length. In the description of this and subsequent embodiments, the same numerals are used to identify the same elements as in the first embodiment and description thereof is omitted.

In the second embodiment, the bearing 28 supporting the support roll 22 is movable in the feed direction of plate A along a guide 47 provided on the base 21. The swing arms 36 provided in front and rear of the bearing 28 have their bottom ends coupled with the bearing 28 by links 42 so that the support roll 22 will move back and forth when the lower rolls 33 of the front and rear movable bodies 26, 27 move up and down.

Cylinders 38 for the front and rear movable bodies 26, 27 push the other ends of the link-coupling portions of the swing arms 36 in opposite directions to balance the swing arms 36.

The cutting device of the second embodiment cuts a plate A in substantially the same way as the cutting device of the first embodiment. In this embodiment, the front and rear movable bodies 26, 27 deflect the plate A downwardly by a predetermined distance between the support roll 22 and the front feed unit 24 when its front end is inserted into between the support roll 22 and the planing cylinder 23, and between the support roll 22 and the rear feed unit 25 when its front end has reached the rear feed unit 25.

By deflecting the plate A downwardly, the contact point between the support roll 22 and the plate A changes, so that the distance between the contact point and the circle circumscribing the planing blades 29 on the cylinder 23 changes. This results in an error in the thickness of the finished plate A.

In the second embodiment, when the front end of the plate A passes the front movable member 26, the plate A is pressed down a predetermined distance by the cylinder 39, so that the swing arms 36 pivot about the pivot shaft 37 by a distance corresponding to the distance by which the plate A has been pressed down. The support roll 22 is thus moved rearwardly through the links 42, so that the contact point between the support roll 22 and the plate A also moves rearwardly. Thus, it is possible to correct the positional relation between the plate and the planing cylinder 23 according to the degree of deflection of the plate A.

Figure 7:
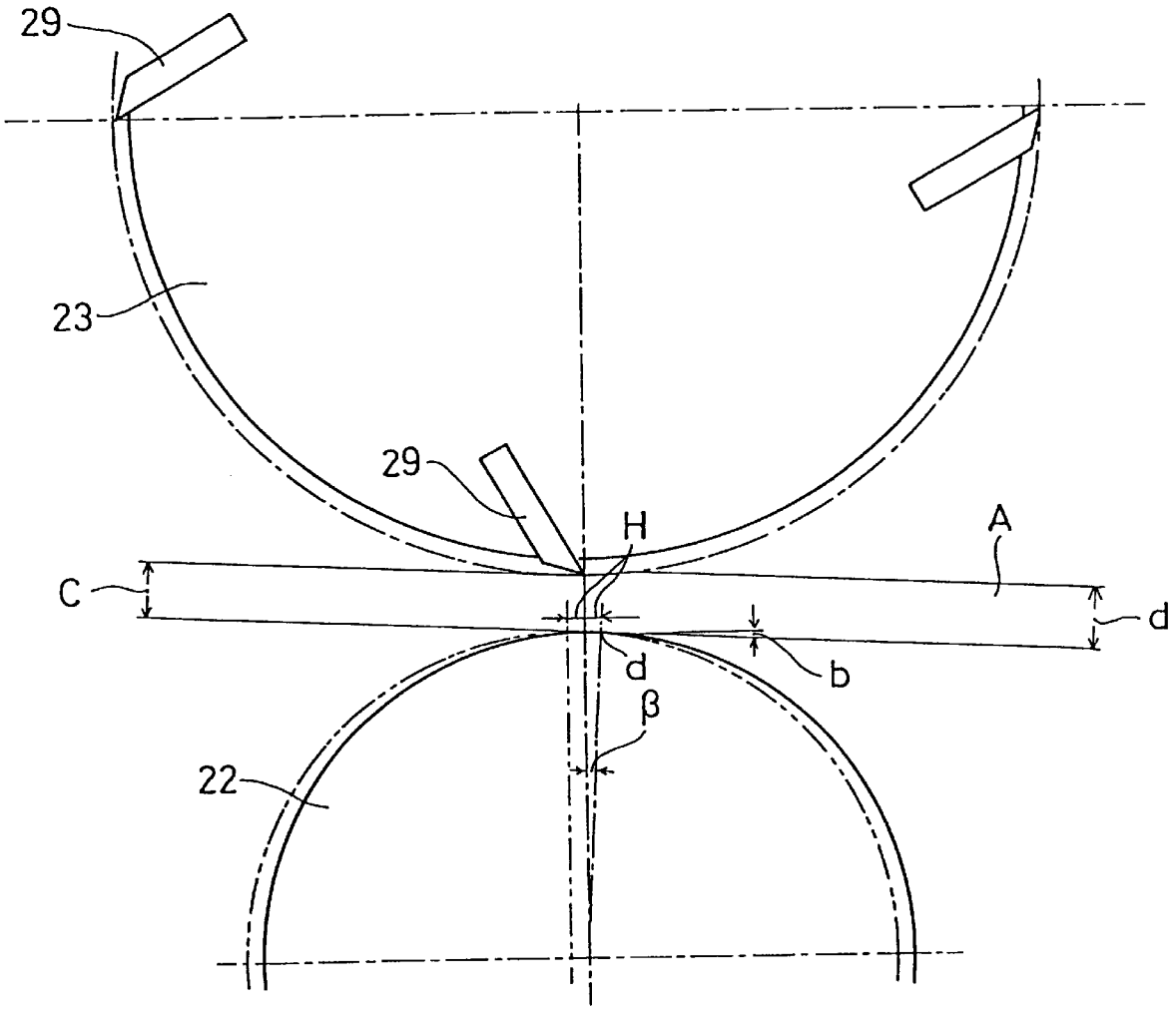
FIG. 7 is an enlarged front view of the cutting portion.

FIG. 7 shows the relation between the contact point between the support roll 22 and the plate A and the planing cylinder 23. If with the axis of the cylinder 23 aligned with the axis of the support roll 22 the plate A is deflected by a predetermined distance downwardly for the distance c between the support roll 22 and the circle circumscribing the planing blades 29, the contact point d between the support roll 22 and the plate A moves an angle β backward (with respect to the feed direction) with respect to the vertical line containing the axis of the support roll 22 and the axis of the cylinder 23, so that when the plate A moves into between the planing cylinder 23 and the support roll 22, it is inclined by an angle b with respect to the horizontal line. Thus, the thickness c of the finished plate will be thinner than when it is fed completely horizontally.

To prevent this, if the support roll 22 is moved backward a distance H corresponding to the contact point d between the support roll 22 and the plate A, the contact point between the support roll 22 and the plate A will move to a position right on the vertical axis of the planing cylinder 23, so that the distance between the support roll 22 and the circle circumscribing the planing blades becomes substantially equal to the thickness c. Thus it is possible to finish the plate A to a predetermined thickness even if the plate A is deflected downwardly.

When the plate A passes the inlet-side plate detector switch S1 and is fed into the front feed unit 24, the switch S1 is turned on. Since the front movable body 26 is lowered to its lowered position, when the plate A reaches the front movable body 26, it is pressed down a predetermined distance, so that the swing arms 36 pivot a predetermined angle. As a result, the support roll 22 moves rearwardly, so that the axis of the support roll 22 is moved to a position behind of the axis of the planing cylinder 23. But the contact point between the support roll 22 and the plate A is located right under the planing cylinder 23.

In this state, the plate A is fed while being cut by the planing cylinder 23. When the front end of the plate A passes the rear feed unit 25 and then the outlet-side plate member detector switch, the latter switch is turned on, so that the rear movable body 27 and the rear feed unit 25 are lowered to their lower positions. Thus the plate A is pressed down a predetermined distance by the rear movable body 27, so that the swing arms 36 pivot and the support roll 22 moves in a reverse direction, that is, forward. Balance is thus maintained with the axes of the planing cylinder 23 and support roll 22 aligned with each other and the contact point between the support roll 22 and the plate A located right under the planing cylinder 23.

In this state, the plate A is fed further while being cut. When the rear end of the plate A passes the inlet-side plate member detector switch, the latter switch is turned off, and the front feed unit 24 and the front movable body 26 rise to their raised positions, so that the pressure on the plate A by the front movable body 26 is released. The abovementioned balance is thus lost, so that the swing arm 36 of the rear movable body 27 pivots further. As a result, the support roll 22 is moved forward, so that the vertical axis of the support roll 22 moves ahead of the vertical axis of the planing cylinder 23. But the contact point between the support roll 22 and the plate A is located right under the planing cylinder 23, so that the plate A can be finished to a predetermined thickness after cutting.

(Third Embodiment)

Figure 8:
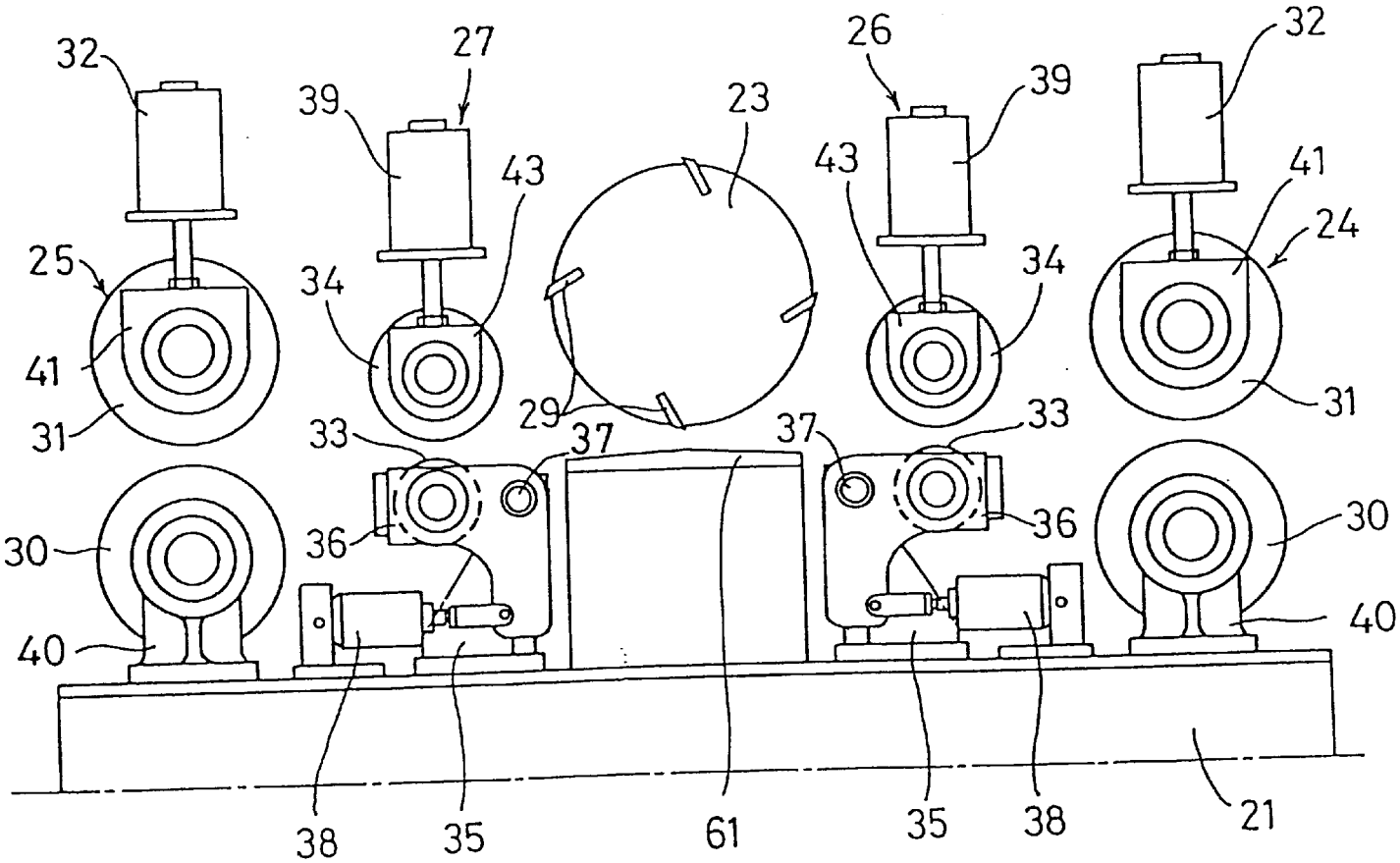
FIG. 8 is a front view of a cutting device of a third embodiment.
Figure 9:
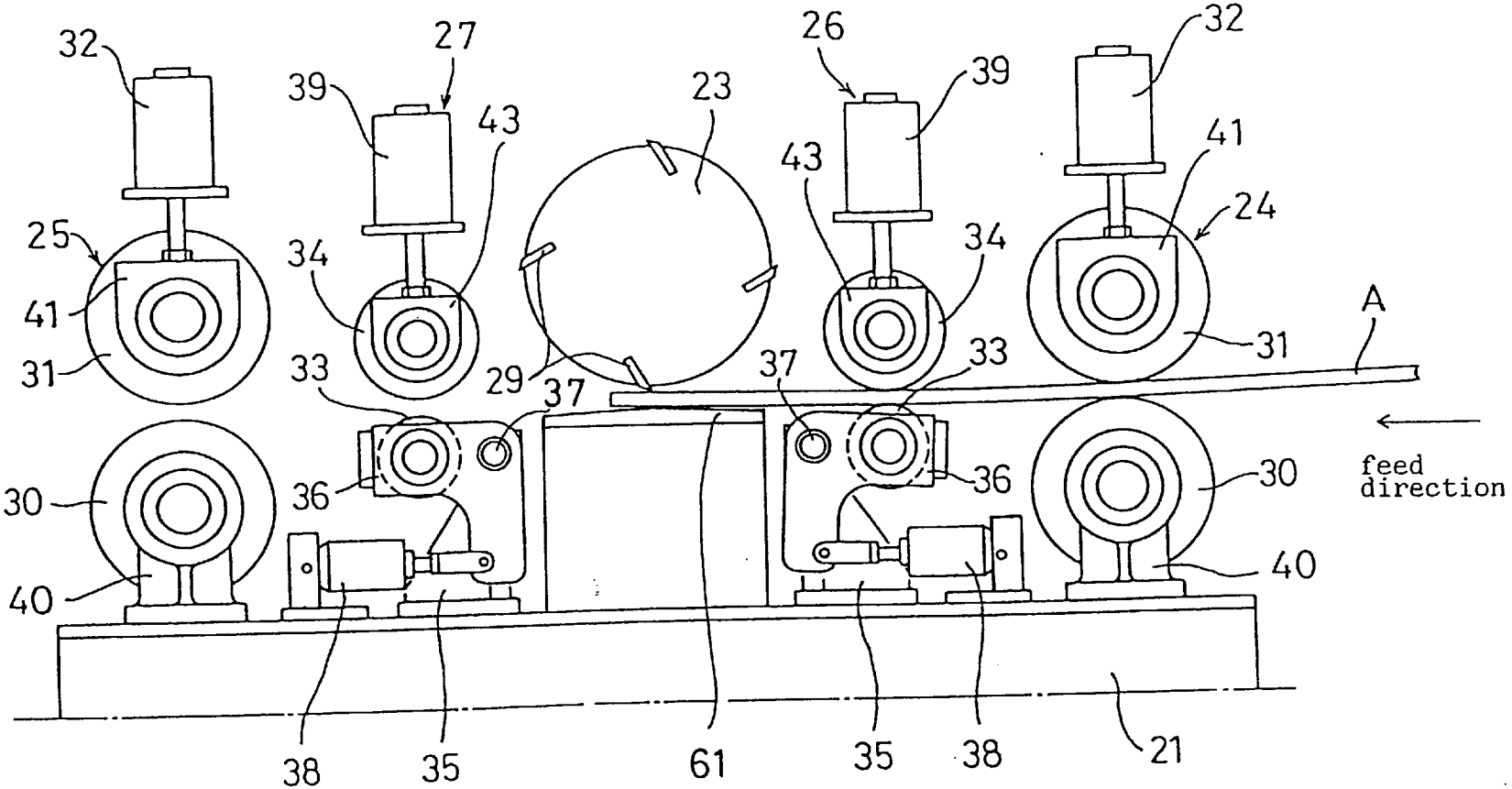
FIG. 9 is a front view of the cutting device of FIG. 8 showing the initial stage of feed of a plate.
Figure 10:
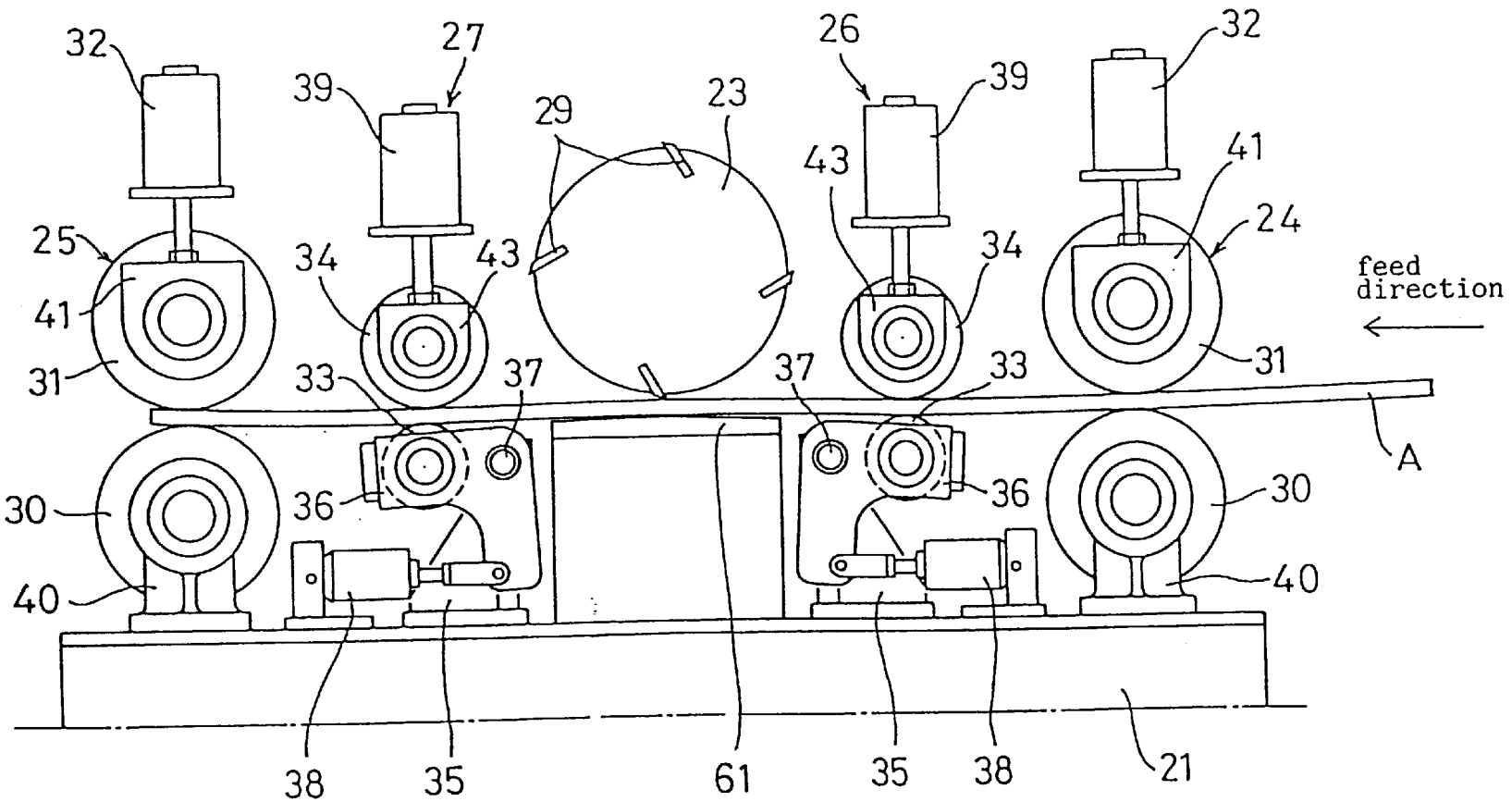
FIG. 10 is a front view of the cutting device of FIG. 8 showing the next stage.

FIGS. 8 through 10 show a cutting device of the third embodiment. Instead of the support roll 22 of the first embodiment, a stationary member is used as a reaction force bearing. It may be a surface plate which is narrow in its width perpendicular to the feed direction of the plate A so as to be able to support the bottom of the plate A at a position right under the axis of the planing cylinder 23. Otherwise, as shown, it may be a fixed support table 61. A projection having a top surface perpendicular to the feed direction of the plate at a position right under the vertical axis of the planing cylinder and having a triangular section is arranged as its apex. In front of this fixed support table 61, the front feed unit 24 and the front movable body 26 are provided. In its rear, the rear feed unit 25 and the rear movable body 27 are provided.

In the third embodiment, too, the plate A is deflected and supported at three points to cut it in substantially the same manner as in the first embodiment.

(Fourth Embodiment)

Figure 11:
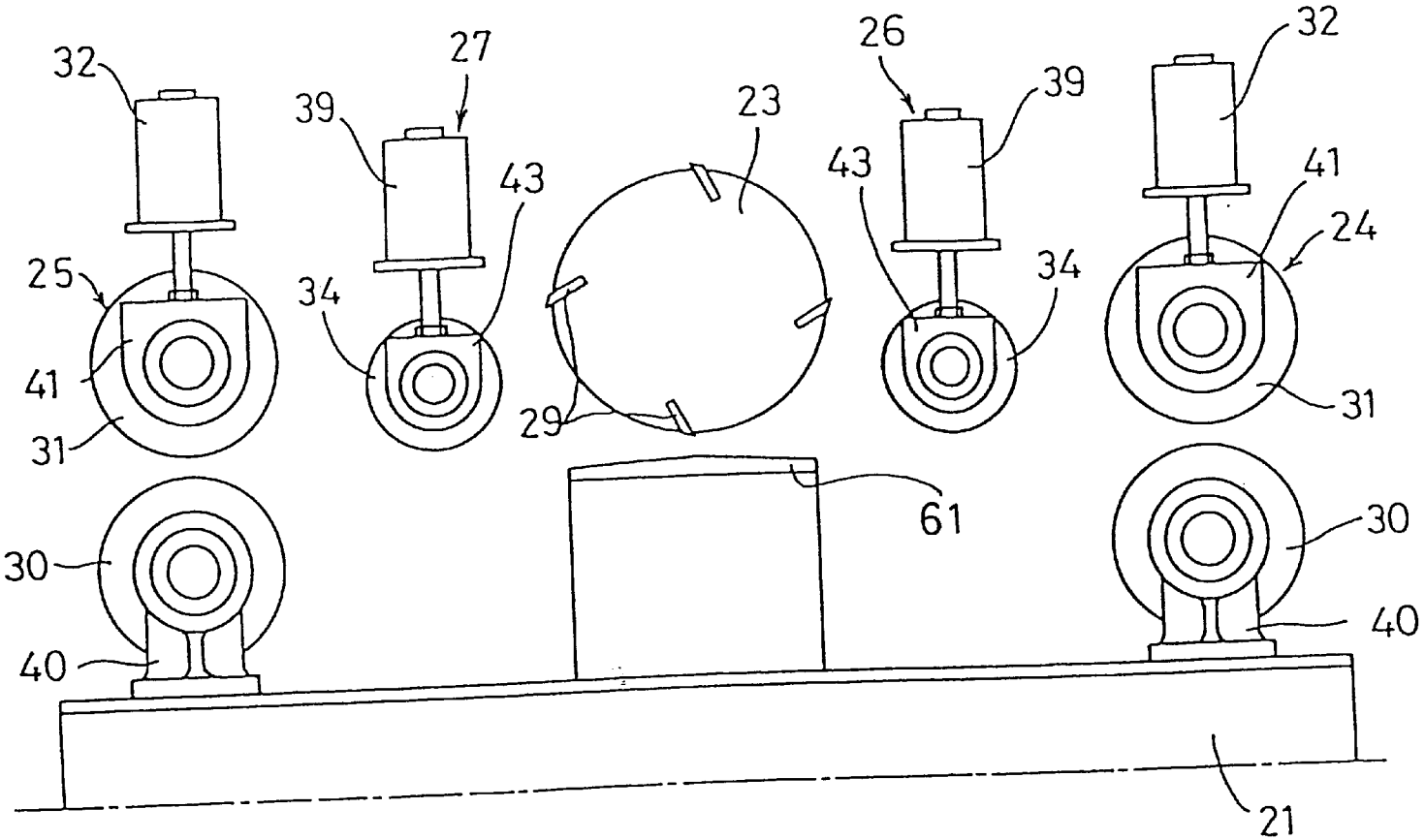
FIG. 11 is a front view of a cutting device of a fourth embodiment.

FIG. 11 shows a cutting device of a fourth embodiment in which the lower rolls 33 of the front movable body 26 and the rear movable body 27 of the third embodiment are omitted. Even though the lower rolls 33 for supporting the underside of the plate A are omitted, if it is thick enough, it is a rigid member, so that it is possible to deflect the plate A while supporting it at three points. Thus, the plate A can be cut in substantially the same manner as in the first embodiment.

(Fifth Embodiment)

Figure 12:
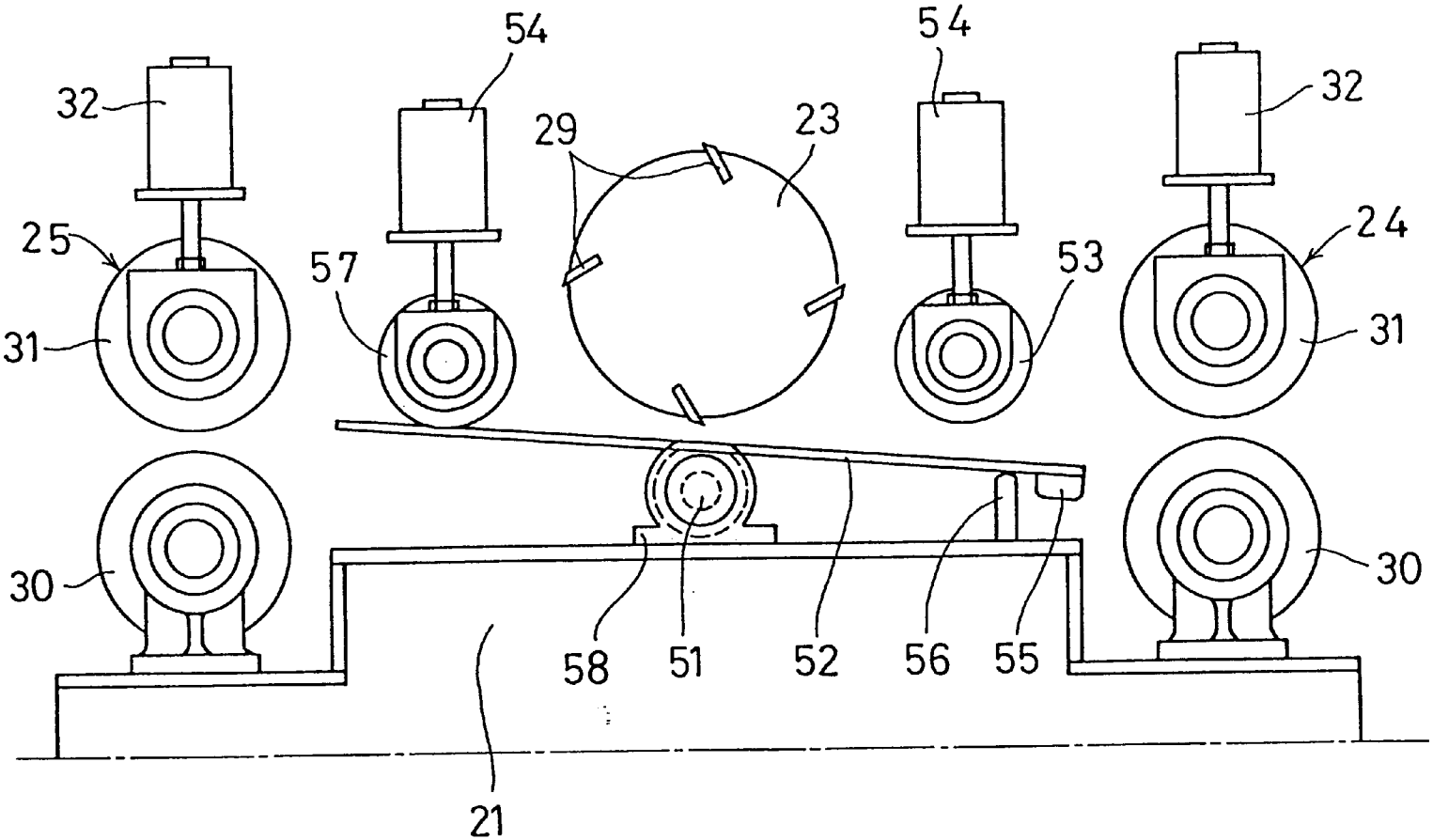
FIG. 12 is a front view of a cutting device of a fifth embodiment.
Figure 13:
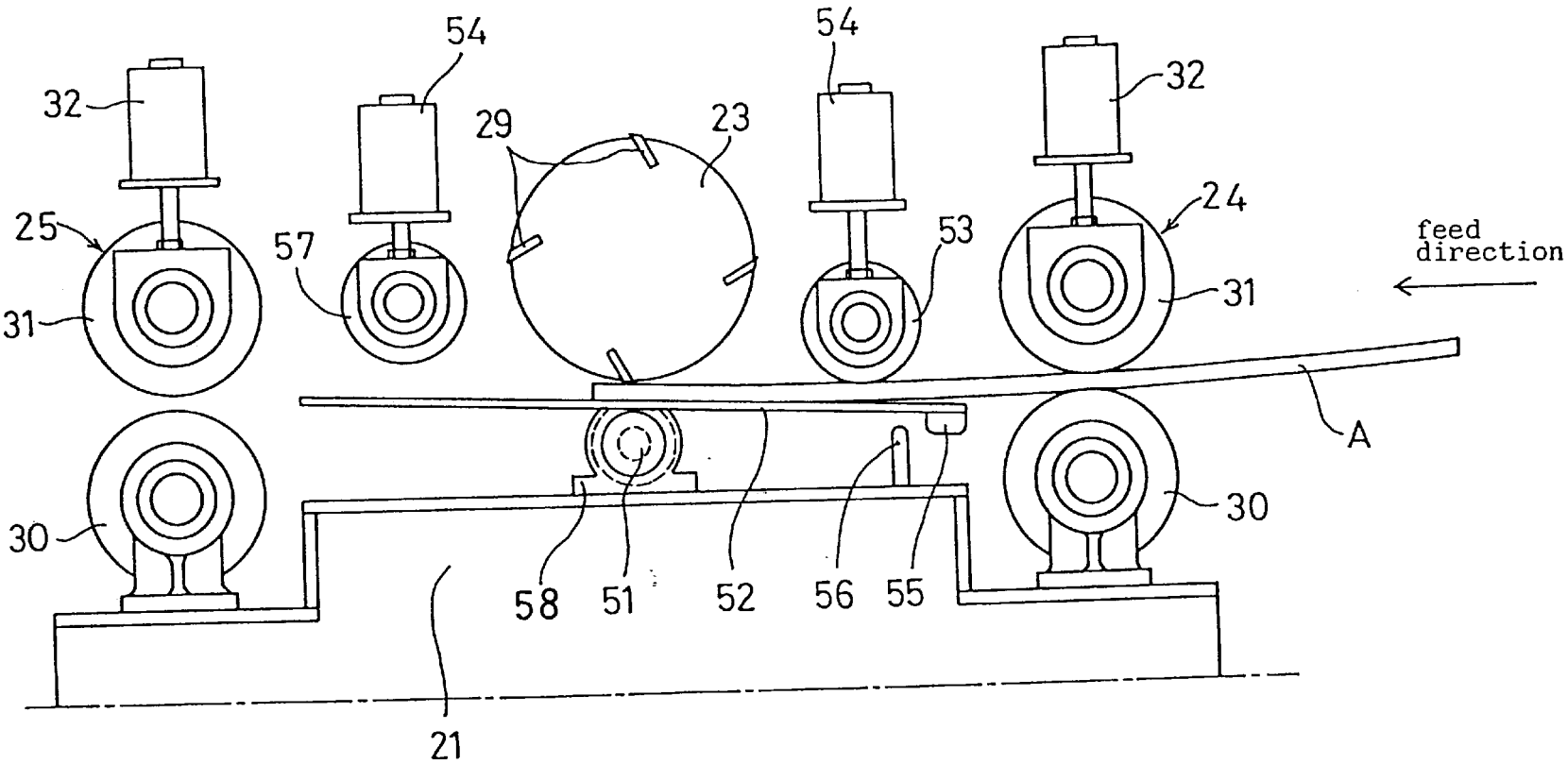
FIG. 13 is a front view of the cutting device of FIG. 12 showing the initial stage of feed of a plate.

FIGS. 12 through 14 show a cutting device of the fifth embodiment in which instead of the support roll 22 of the first embodiment, a pivotable plate member support plate is used as a reaction force bearing.

The cutting device of the fifth embodiment has a plate support plate 52 provided under a planing cylinder 23 which rotates at a fixed position, so as to extend in the feed direction of the plate and be pivotable about a pivot shaft 51. In front (with respect to the feed direction of the plate A) and rear of the plate support plate 52, front and rear feed units 24, 25 are provided which grip a plate A between vertically arranged rolls. Further, in front (with respect to the feed direction of the member A) and rear of the planing cylinder 23, front and rear movable bodies 53 and 57 are provided over the plate support plate 52 to grip the plate A between the respective bodies and the plate support plate 52.

The plate support plate 52 is elongated in the feed direction of the plate A and is made of a material flexible enough to be deflectable along the plate. It is fixed at its bottom center to a pivot shaft 51 which has its both ends rotatably supported on pivot shaft bearings 58 mounted on the base 21, so as to be pivotable about the pivot shaft 51. A weight 55, mounted to its bottom at one end thereof from which the plate A enters, keeps the plate 52 inclined by an angle limited by a pin 56 provided on the base 21 so as to slope downward toward its plate-entering end.

The front movable body 53 and the rear movable body 57 have movable rollers that are urged downward by hydraulic cylinders 54 or springs to grip the plate A between the rollers and the plate support plate 52.

As shown in FIGS. 13 and 14, when the plate A is fed into the front feed unit 24, the inlet-side plate detector switch turns on and the front movable body 53 lowers to its lowered position. In this state, the leading end of the plate A is slid on the inclined plate support plate 52. When its front end passes the front movable body 53, it is gripped between the front movable body 53 and the plate support plate 52 and fed while being pressed down a predetermined distance. When the front end of the plate A reaches the point right over the center of the support shaft 51, the plate A is fed while being deflected downward between the lower roll 30 of the front feed unit 24 and the portion of the plate support plate 52 right over the center of the pivot shaft 51, so that the front end of the plate A is fed while being pressed reliably against the plate support plate 52.

It is thus possible to prevent floating when it is inserted into between the planing cylinder 23 and the plate support plate 52. Thus the plate A is fed between the plate support plate 52 and the planing cylinder 23 while being cut by the planing cylinder 23, and then fed into the rear movable body 57 and rear feed unit 25. When the front end of the plate A passes the outlet plate detector switch and turns it on, the rear movable body 57 and the rear feed unit 25 lower to their lowered positions, so that the plate A is gripped between the rear movable body 57 and the plate support plate 52. The plate is thus fed while being pressed down a predetermined distance. It is deflected downward between the portion of the plate support plate 52 right over the center of the pivot shaft 51 and the lower roll 30 of the rear feed unit 25. Thus, the rear end of the plate A is fed while being pressed reliably against the plate support plate 52, so that it is possible to prevent floating when the rear end of the plate A passes between the planing cylinder 23 and the plate support plate 52.

Since the plate is pressed down a predetermined distance by the lower rolls 30 of the front and rear feed units 24, 25 between the portion of the plate support plate 52 right over the center of the pivot shaft 51 and the front and rear feed units 24, 25 and supported at three points, the plate A is deflected about the portion of the plate support plate 52 right over the center of the pivot shaft 51. Since the plate support plate 52 is flexible, it is deflected together with the plate A, so that the plate A is pressed reliably against the plate support plate 52 at its front and rear ends. Thus, it is possible to prevent floating and thus the formation of depressions on the plate A near its front and rear ends.

In the fifth embodiment too, the method described with respect to the second embodiment may be used. Namely the pivot shaft 51 may be movable in the feed direction of the plate A, so that when the plate A is deflected, the plate support plate may be adapted to be moved forward or backward.

By deflecting the plate A by a predetermined amount, it can be reliably brought into contact with the plate support plate 52 at its front and rear ends, so that it is possible to prevent floating. Thus, the formation of depressions in the plate A near its front and rear ends can be prevented.

While the cutting devices of the embodiments are all planing machines having planing cylinders, sanders for automatically cutting the surface of a plate may be used instead of planing cylinders. While the reaction force bearing is provided right under the planing cylinder, the former may be provided right over the latter. Although roll type structures are used as front and rear feed units 24, 25, endless moving mechanisms such as conveyors may be used.

As described above, according to this invention, before and after the cutter, a plate is deflected while supporting it at three points to keep it pressed against the reaction force bearing during cutting. Thus during cutting, the front and rear ends of the plate member will never float, so that it is possible to prevent the formation of depressions in the plate during cutting. Deflection is applied by the rolls that are rotatable, so that because a conventional pressure bar or a chip breaker is not necessary, resistance to the feed of the plate is small, and thus the power required to feed the plate can be saved.

What is claimed is:

1. A method of cutting a plate, the method comprising:

feeding a plate in a feed direction between a cutter and a reaction force bearing, wherein the cutter and the reaction force bearing are disposed between a front feed unit and a rear feed unit, and wherein a front movable body is provided between the cutter and the front feed unit, and a rear movable body is provided between the cutter and the rear feed unit; and deflecting the plate by operation of the front movable body so as to bring the plate into contact with the front feed unit, the front movable body and the reaction force bearing.

2. The method as claimed in claim 1, further comprising deflecting the plate with the rear movable body so as to contact the plate with at least the rear movable body, the reaction force bearing, and the front movable body.

3. The method as claimed in claim 1, further comprising actuating the rear movable body and the rear feed unit when a leading end of the plate is received in the rear feed unit.

4. A device for cutting a plate as the plate is fed in a feed direction, said device comprising:

a reaction force bearing member;

a rotatable cutter disposed over said reaction force bearing member;

a front feed unit disposed upstream of said cutter with respect to the feed direction of the plate;

a rear feed unit disposed downstream of said cutter with respect to the feed direction of the plate;

a front movable body, disposed between said cutter and said front feed unit, for deflecting the plate downward;

a rear movable body, disposed between said cutter and said rear feed unit, for deflecting the plate downward; and means for moving said front movable body and said rear movable body upward and downward.

5. The device as claimed in claim 4, wherein said reaction force bearing member comprises a plate support plate that is pivotal about a point located under a rotation axis of said cutter.

6. The device as claimed in claim 4, wherein said reaction force bearing member comprises a fixed table, a projection, a fixed table having a convex upper surface, a rotatable roll, or a plate support plate that is pivotally mounted about a point located under a rotation axis of said cutter.

7. The device as claimed in claim 4, wherein each of said front and rear feed units comprises a pair of opposing rolls.

8. The device as claimed in claim 4, wherein said means for moving said front and rear movable bodies comprise hydraulic cylinders or pulse motors.

9. The device as claimed in claim 4, wherein each of said front and rear movable bodies comprises a pair of opposing rolls.

10. The device as claimed in claim 4, wherein said reaction force bearing member comprises a flexible support plate.

11. The device as claimed in claim 4, wherein said front feed unit comprises:

a rotatable lower roll mounted on a base;

a rotatable upper roll disposed over said lower roll; and a hydraulic cylinder connected to said upper roll for moving said upper roll toward and away from said lower roll.

12. The device as claimed in claim 11, wherein said rear feed unit comprises:

a rotatable lower roll mounted on a base;

a rotatable upper roll disposed over said lower roll; and a hydraulic cylinder connected to said upper roll for moving said upper roll toward and away from said lower roll.

13. A device for cutting a plate as the plate is fed in a feed direction, said device comprising:

a base;

a reaction force bearing member mounted on said base;

a rotatable cutter disposed over said reaction force bearing member;

a first feed unit disposed upstream of said cutter with respect to the feed direction of the plate;

a second feed unit disposed downstream of said cutter with respect to the feed direction of the plate;

a first movable body, disposed between said cutter and said first feed unit, for deflecting the plate downward;

a second movable body, disposed between said cutter and said second feed unit, for deflecting the plate downward;

a first elevator for moving said first movable body downward; and a second elevator for moving said second movable body downward.

14. The device as claimed in claim 13, wherein said first feed unit comprises:

a rotatable lower roll mounted on said base;

a rotatable upper roll disposed over said lower roll, wherein said upper roll is movable relative to said lower roll; and a hydraulic cylinder connected to said upper roll for moving said upper roll toward and away from said lower roll.

15. The device as claimed in claim 14, wherein said second feed unit comprises:

a rotatable lower roll mounted on said base;

a rotatable upper roll disposed over said lower roll, wherein said upper roll is movable relative to said lower roll; and a hydraulic cylinder connected to said upper roll for moving said upper roll toward and away from said lower roll.

16. The device as claimed in claim 13, wherein each of said first and second elevators comprises a hydraulic cylinder.

* * * * *